US005186705A

United States Patent [19]

Doderer-Winkler

[11] Patent Number: 5,186,705

[45] Date of Patent: Feb. 16, 1993

[54] METHOD AND APPARATUS FOR FORMING CLASP ENVELOPES

[75] Inventor: Alfred Doderer-Winkler, Melsbach, Fed. Rep. of Germany

[73] Assignee: Winkler & Dunnebier, Fed. Rep. of Germany

[21] Appl. No.: 806,251

[22] Filed: Dec. 13, 1991

[51] Int. Cl.[5] ..... B31B 19/90

[52] U.S. Cl. ..... 493/215; 493/385; 493/468; 269/310; 29/243.56

[58] Field of Search ..... 493/215, 385, 392, 468, 493/474; 269/310, 316, 317; 29/243.56, 251

[56] References Cited

U.S. PATENT DOCUMENTS

| | | | |
|---|---|---|---|
| 965,252 | 7/1910 | Swift | 493/215 |
| 1,328,472 | 1/1920 | Affelder | 493/215 |
| 1,508,467 | 9/1924 | Novick | 493/392 |
| 1,615,195 | 1/1927 | Swab | 493/392 |
| 1,659,516 | 2/1928 | Compton | 493/385 |
| 1,726,003 | 8/1929 | Snyder | 493/392 |
| 2,269,954 | 1/1942 | Novick | 493/392 |
| 2,362,261 | 11/1944 | Francis et al. | 493/385 |
| 3,792,855 | 2/1974 | Bondie | 269/310 |
| 3,804,319 | 4/1974 | Piechocki | 269/310 |
| 3,893,381 | 7/1975 | Chapman et al. | 493/392 |

FOREIGN PATENT DOCUMENTS

| | | | |
|---|---|---|---|
| 3830084 | 3/1990 | Fed. Rep. of Germany | 493/215 |

OTHER PUBLICATIONS

Advertisement for Helios 249.

*Primary Examiner*—William E. Terrell

*Attorney, Agent, or Firm*—Kokjer, Kircher, Bowman & Johnson

[57] ABSTRACT

An approved method and apparatus for forming clasp envelopes. The apertures extending through the top and bottom panels of the envelope body and the clasp receiving aperture extending through the top flap are formed after the envelope has been completely assembled save for the folding of the top flap for shipping. This ensures that the apertures extending through the top and bottom panels of the envelope body are in perfect registration. Reinforcement tape is applied on the top flap of the envelope, through which the aperture in the top flap extends, after the envelopes have been cut from the continuous strip of envelope blanks. This ensures that the cutting device used to sever the continuous strip into individual envelopes must cut only paper, thus improving longevity of the cutting device, and allows a single punch device to be used to form the hole and the apertures. Additionally, the method and apparatus employ an improved device for applying the clasp to the back panel of the envelope body. This clasp attaching device includes a resilient anvil which is adjustable to vary the prong insertion depth and is completely removable to allow test runs without the application of the clasps.

7 Claims, 2 Drawing Sheets

METHOD AND APPARATUS FOR FORMING CLASP ENVELOPES

BACKGROUND OF THE INVENTION

1. Field of the Invention

The present invention relates in general to a method and apparatus for forming envelopes. In particular, the present invention relates to an improved method and apparatus for forming clasp envelopes, including an improved apparatus for attaching the clasp to the envelope.

2. Description of the Related Art

Clasp envelopes have been known for a number of years. Such envelopes are typically formed of paper folded to form front and back panels joined about three sides to define a pouch therebetween. The fourth side typically includes an openable flap to close the aperture of such pouch. The flap includes a hole, which, when the flap is in the closed position, registers with a metallic clasp fixed to the back panel of the envelope and having two projections extending in opposite directions. These projections may be bent upwardly to be received through the hole in the flap and then bent back to their original flat position to engage the upper surface of the flap to thereby retain the flap in the closed position. Various arrangements are known for forming the upper and lower panels sealed about the three sides, including folding the envelope blank approximately in half and sealing along the remaining two of the three sides, or alternatively folding side flaps and an end flap inwardly and sealing along the lower side and center seam.

While the folding and sealing of such envelopes may be readily accomplished with prior art devices, these devices have typically had difficulty attaching the clasp to the envelope. This is due to the fact that the clasp is typically attached to the envelope by passing one or more prongs struck from the clasp through the back panel of the envelope and then deforming these prongs to fix the clasp in place.

This arrangement is preferable in that it provides a strong attachment with low material costs, but it has been difficult to avoid damaging the front panel during the attachment step. This attachment step has often been carried out on a separate machine from that which folds and seals the envelope, resulting in increased complexity and capital outlays.

Another problem in the prior art has been the formation of apertured clasp envelopes. Such envelopes are similar to those described above, but include a series of apertures extending through the pouch portion of the front and back panels. These apertures allow viewing to determine if contents are present within the envelope, and are typically employed for interoffice mail.

On difficulty experienced in the prior art method and devices has been in the registration of these apertures. In particular, the location of the apertures in the envelope blank, and the location of the fold or folds to form the front and back panels, must be tightly controlled to ensure that the apertures are properly registered. This tight control has required prior art assembly machines to be more expensive and require constant adjustment. A second difficulty is that perforating to form the apertures takes place prior to folding, and the chips formed by perforation tend to either back up in the dies or become strewn downstream, interfering with other operations in the envelope forming process.

One prior art device for producing such envelopes is available from the W & D Machinery Company, Inc. of Overland Park, Kans., under model Helios 249. In this device, a roll of stock paper is mounted at the input end and fed into the device. The stock paper passes over appropriate tensioners, and printing means if applicable. Thereafter, the paper undergoes one or more appropriate cutting and scoring steps to remove material to form a continuous series of unfolded envelope blanks. Appropriate adhesive is applied to those flaps which will form the back panel of the envelope, and these flaps are then folded by appropriate guides.

During this folding, the flaps to form the back panel are folded over a support plate which is thus received between the front and back panels of the partially formed envelope. Once the flaps to form the back panel have been properly folded down, a clasp attaching device as shown in U.S. Pat. No. 4,994,010 forces the prongs of the clasp into the back panel of the envelope using the support plate as an anvil. Thereafter, a set of pinch rollers complete the deformation of the prongs, again using the support plate as an anvil.

Following attachment of the clasp, the continuous strip of partially formed envelopes are severed to form individual partially formed envelopes, and adhesive is applied to the lower flap which is then folded into position. If appropriate, an adhesive for later sealing of the top flap is applied thereto and the envelopes placed in a partially overlapping relationship ("collated") with the top flaps being exposed. These collated envelopes are then fed through a dryer to remove all tackiness from the adhesive applied to the top flap. Thereafter, the envelopes are removed from the collated relation, the top flap folded to its closed position, and the envelopes formed into a stack.

While the Helios 249 device has greatly improved the ease of attaching the clasp to the back panel, it still suffers from the above-noted problems of registration of the apertures in the front and back panels and chip distribution. Additionally, the clasp attaching mechanism is adjustable vertically as a whole with respect to the guide bar/anvil, which requires a great deal of trouble to adjust the insertion of the clasp prongs.

SUMMARY OF THE INVENTION

An object of the present invention is to provide a method and apparatus for forming clasp envelopes which provides a simple and reliable means for forming registered apertures through the front and back panels of the envelope.

Another object of the present invention is to provide an apparatus for attaching clasps to the back panel of the envelope which allows easy adjustment of the prong insertion depth.

A further object of the present invention is to provide a method and apparatus for forming clasp envelopes in which reinforcement tape for the top flap aperture is applied subsequent to forming of the envelope.

These and other objects are achieved by an improved method and apparatus for forming clasp envelopes. The apertures extending through the front and back panels of the envelope body and the clasp receiving hole extending through the top flap are formed after the envelope has been completely assembled save for the folding of the top flap for shipping. This ensures that the apertures extending through the front and back panels of the envelope body are in perfect registration. Reinforcement tape is applied on the top flap of the envelope, through which flap the hole in the top flap extends, after the envelopes have been cut from the continuous strip of envelope blanks. This ensure that the cutting device used to sever the continuous strip into individual envelopes must cut only paper, thus improving longevity of the cutting device, and allows a single punch device to be used to form the hole and the apertures.

Additionally, the method and apparatus employ an improved device for applying the clasp to the back panel of the envelope body. This clasp attaching device includes a resilient anvil which is adjustable to vary the prong insertion depth and is completely removable to allow runs without the application of the clasps.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
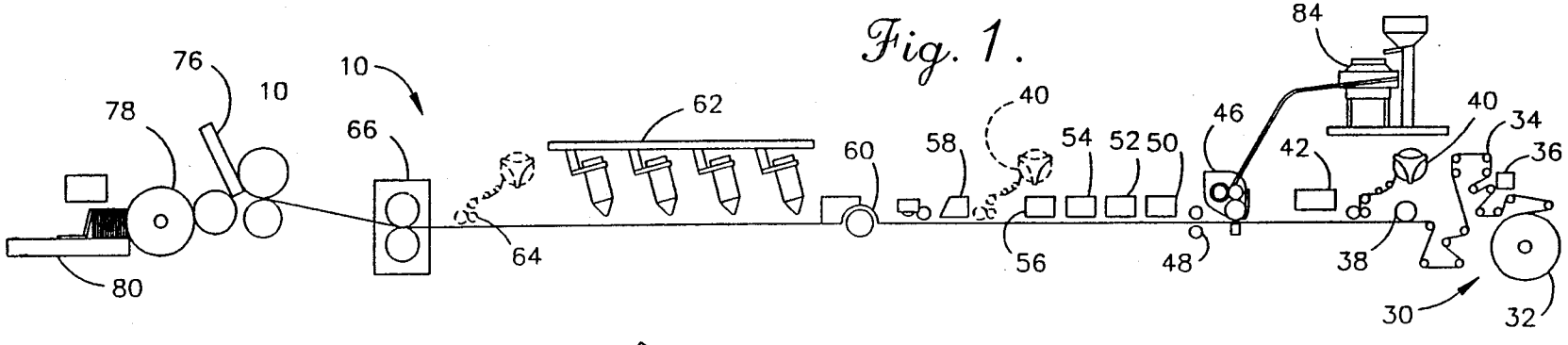
FIG. 1 is a schematic side view showing the device according to the present invention.
Figure 5:
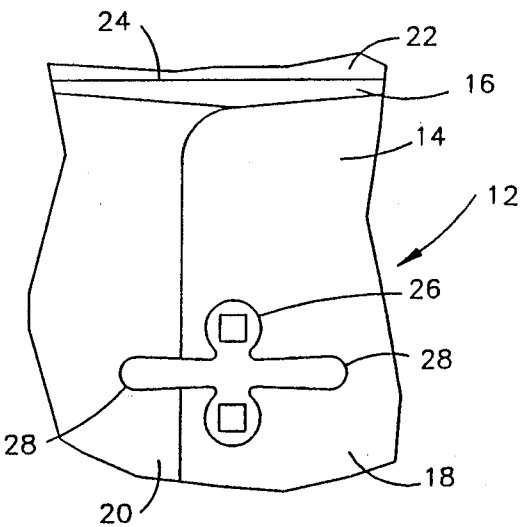
FIG. 5 is a top view of a clasp attached in accordance with the present invention.
Figure 6:
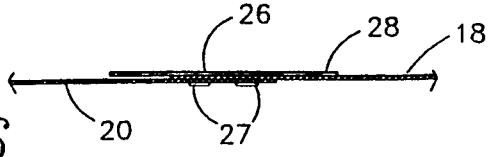
FIG. 6 is a cross-sectional side view of the clasp shown in FIG. 5.

With reference to FIG. 1, the device according to the present invention is generally designated by reference numeral 10. This device is employed to form clasp envelopes. A partial view of such an envelope is shown in FIGS. 5 and 6, with this envelope being generally designated by reference numeral 12. As is best shown in FIG. 5, the envelope 12 includes a back panel 14 and a front panel 16 which are closed about three sides (not shown) to define a interior cavity.

The side edges are typically formed by folding the stock material. As such, in FIG. 5, the folds are formed at the junction of the front panel 16 and first and second side flaps 18 and 20. These side flaps thus form the back panel 14. At the lower end of the envelope, the third side edge will be formed by a fold between the front panel 16 and a bottom flap (not shown) which is folded over and adhered to the back panel 14. To fully close the envelope 12, a top flap 22 is provided. The top flap 22 is formed integrally with the front panel 16 and separated therefrom by a top flap score line 24. To close the envelope 12, the top flap 22 is folded about the score line 24 which will bring a clasp hole (not shown) into registration with a clasp 26 fixed to the back panel 14.

The clasp 26 is typically formed of a thin gauge metal having one or more sets of prongs 27 struck therefrom and engaging with the back panel 14, as is best shown in FIG. 6. The clasp 26 includes a pair of clasp extensions 28 extending in opposite directions therefrom. These extensions may be bent upwardly to be received within the clasp hole in the top flap 22 and then bent downwardly to their original position to secure the top flap in the closed position, as is known in the art.

With reference to FIG. 1, the device according to the present invention will be described.

At the right hand end of this figure there is a feed section generally designated by reference numeral 30. Feed section 30 includes appropriate chucks to receive a roll of stock paper 32. The paper 32 is fed through a series of tensioning rollers 34 to provide a supply of properly tensioned stock paper at the proper speed. A printing device 36 may be supplied in the feed section to provide the stock paper with appropriate exterior indicia.

The tensioned (and possibly printed) stock paper 32 is then fed beneath a pair of scoring rolls 38 which provide appropriate longitudinal score lines to form the side flaps 18 and 20 of the envelope. The paper next passes below a reinforcement tape applicator 40 which applies a small amount of reinforcement tape in an area which will eventually correspond to the clasp hole in the top flap of the envelope. It is noted that in the prior art, the clasp hole was punched immediately after application of this reinforcement tape. In the present invention the tape application is not followed by this hole punching, but is followed by a cutting and adhesive station 42.

The cutting and adhesive station 42 will cut sections from the paper 32 at appropriate intervals to form the side flaps 18 and 20 and the lateral edges of the top and bottom flaps, as is known in the art. Additionally, an appropriate adhesive will then be applied to one or more of the side flaps which will serve to maintain the side flaps in their assembled condition to form the back panel 14. To form the back panel, appropriate guides are provided (not shown) to fold the side flaps about the longitudinal score lines into a position overlying the front panel 16. This arrangement is similar to that shown in U.S. Pat. No. 4,994,010, which is incorporated herein by reference.

Also similar to this above noted patent, an opposing support plate 44 (FIG. 2) is interposed during this folding between the front and back panels. Specifically, the stock paper is passed beneath the support plate 44 during the folding of the side flaps such that the side flap or flaps are folded over the support plate 44 and the continuous strip of paper 32 forms a flattened tube about the support plate 44.

The support plate 44 extends downstream beneath a clasp applicator 46. As such, the clasp applicator 46 may insert the prongs of a clasp through the back panel 14 and the prongs will abut against, and be deformed by, the support plate 44. During this operation the support plate is, in turn, supported by an anvil means which will be discussed in detail below. As may be readily envisioned, the provision of the support plate 44 ensures that the front panel 16 is not damaged by the application of the clasp, and there is no opportunity for the clasp to engage with the front panel 16.

A free end portion of the support plate 44 extends downstream of the clasp applicator 46 through a pair of pinch rolls 48. As the applied clasp passes through the pinch rolls 48, the pressure applied thereby fully deforms the prongs of the clasp to complete its application. As before, the support plate provides an abutment, and is itself supported by the lower pinch roll via the front panel 16.

Located downstream of the pinch rolls 48 is a severing device 50. The severing device forms a transverse cut through the stock paper at a point spaced between adjacent front panels 16, thereby forming the bottom and top flap, respectively, of adjacent envelopes. Downstream of the severing device 50 is a transverse score roll 52 which serves to form the top flap score line 24 and a similar bottom flap score line. The score roll 52 could, of course, be located upstream of the severing device 50.

Downstream of the transverse score roll 52 is located an adhesive applicator 54 and bottom flap folder 56. These two devices serve to seal the bottom of the envelope, in a manner known in the art.

Downstream of the bottom flap folder 56 is an alternative location for the tape applicator 40. This is indicated by dashed lines in FIG. 1. By placing the tape applicator 40 at this position, which is downstream from the transverse severing device 50, it is assured that the severing device will not cut through the reinforcement tape applied by the applicator 40. This will help to increase the life of the severing device 50.

Downstream of the bottom flap folder 56 (and alternative location for tape applicator 40) is a top flap adhesive applicator 58. This applicator serves to form a layer of adhesive, if required, upon the top flap 22 of the envelope. This adhesive will be employed by the end user to seal the envelope in use.

To ensure that the adhesive applied by applicator 58 is thoroughly dry and will not prematurely seal the envelope or cause the envelope to stick to an adjacent envelope, the adhesive must be dried. To this end, a partial collator 60 and a drier 62 are provided. The partial collator 60 reduces the normal spacing between the envelopes traveling through device 10 and places them in a sequential overlying relation such that the top flaps 22, and thus the adhesive thereon, are the only exposed portions. In this manner, when the collated envelopes travel through the dryer 62, the heat and/or forced heated air will impinge only upon the portion of the envelope which requires such heat, reducing energy costs.

To allow the collating of the envelopes for travel through the dryer, the conveyance of the envelopes through the dryer is slower than through the other portions of the device 10. This slower conveyance speed also means that the longitudinal length of the dryer need not be as long as would be required for higher speed envelope conveyance. This additionally reduces material and energy costs.

Upon exiting the dryer 62 the adhesive on the top flap 22 has been fully dried and is no longer tacky. At this point the envelopes pass through a decollator 64 which remove the envelopes from their partially collated configuration and once again places them in the sequential configuration. As should be apparent from the discussion above, the conveyance speed downstream of the decollator is higher than that through the dryer, and is preferably approximately equal to that upstream of the partial collator 60. Immediately downstream of the decollator 64 may be an additional alternative location for the reinforcement tape applicator tape, 40. As with the previous alternative position, placing the applicator 40 downstream of the decollator 64 will serve to increase the life of the transverse severing device 50, and provides a further advantage discussed below.

Figure 4:
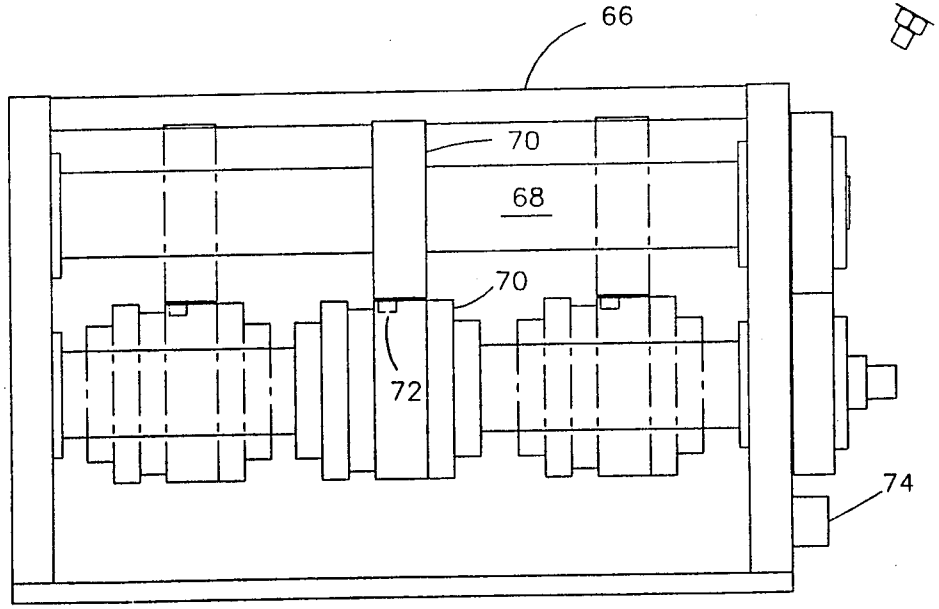
FIG. 4 is a front view of the punch assembly according to the present invention.

Downstream of the decollator 64 (and possibly the reinforcement tape applicator 40) is located a punch device 66. As is best shown in FIG. 4, the punch device 66 at least includes a punch to form the clasp hole within the top flap 22. Additionally, the punch device may include additional punches to form the apertures through the body of the envelope (through the front and back panels) as indicated by dash line in FIG. 4. Although various types of punch devices may be employed, it is preferred that rotary punches be employed, with such a rotary punch including at least one pair of shafts 68 supporting rollers 70. One of these roller will include a punch 72 which will cooperate with the associated roller 70, which may have a resilient exterior to allow the punch 72 to cut through the paper forming the envelope.

As is well known in the art, the shafts 68 may be adjustable to provide optimum operation with various paper thicknesses. Additionally, it is preferred that the punch device 66 include an appropriate orifice 74 for attachment of the suction side of a fan (not shown) to act as a waste chip collection system to remove the waste chips from the punch device 66. A suitable punch device 66 ma be obtained from Economy Machine And Tool Company, Inc. of Green Bay, Wis., under Model No. 4-161.

Downstream of the punch device 66 is a top flap folder 76 which may be employed in those situations where the envelopes are to be packaged with the top flap closed. Associated with the top flap folder 76 is a stacker 78 which serves to collect the completed envelopes in an orderly pile upon on output table 80. From their stacked position on the output table 80 the completed envelopes may be fed to a separate conveyor system for placing the envelopes in the appropriate package.

The remaining details of the device 10 should be readily apparent to those skilled in the art. For example, the movement of the stock paper and the envelopes through the device 10 may be effected by various known conveyor systems, and may be advantageously employ drive rollers engaging the stock paper and envelopes upstream and downstream of the partial collater 60 and dryer 62, with a conveyor belt being employed in the area containing partial collater 60 and dryer 62. Additionally, the controls to operate the various cutters, adhesive applicators and reinforcement tape applicator may include simple timers, proximity switches, optical sensors or other well known means.

From the above description of the device it may be seen that the present invention is a simplification over the previous Helios 249 device, will provide longer wear for the transverse severing device 50, and will provide exact registration of the apertures extending through the body of the envelope, thus creating a better product. Additionally, the punch device employed to form the apertures may also be employed for forming the hole in the top flap, thus reducing the cost of the machine.

Forming the hole so near the end of the line allows the reinforcement tape to be applied at any convenient upstream location, such as downstream of the transverse severing device. It is also advantageous to place the tape applicator downstream of the decollater. In such an arrangement the envelopes will be partially collated, and decollated, without the presence of the tape on the top flap. This eliminates the possibility of the tape interfering with the partial collating, reducing down time for the apparatus.

The operation of the device should be clear from the above description, however, the present method of envelope formation will be briefly reiterated.

Stock paper is first printed, if necessary, and then provided with appropriate longitudinal score lines. Subsequent to this, a patch of reinforcement tape may be applied to the location which will correspond to the clasp hole in the top flap of the formed envelope. Next, the side flaps, defined by the longitudinal score lines, are folded over to form the back panel of the envelope, with appropriate adhesive being applied to maintain the side flaps in the folded condition. Once the side flaps have been sufficiently folded to their operative position, a clasp is attached to the back panel of the partially completed envelope, and is thereafter fully applied by the pinch rolls 48. The continuous strip of partially formed envelopes is then severed into individual envelope blanks by a severing device and thereafter transverse score lines are formed to define the top and bottom flaps of the envelope. Adhesive is applied to the bottom flap and it is folded over to further form the envelope.

Subsequent to the folding of the bottom flap, the patch of reinforcement tape, if not previously applied, may be applied to the top flap. Subsequently, the adhesive is applied to the top flap and the envelopes placed in a partially collated configuration and their rate of conveyance reduced as they pass through a dryer which dries the adhesive on the top flap. After having the top flap adhesive dried, the envelopes are then decollated and placed in their sequential configuration and may alternatively receive the reinforcing patch at this time. The envelopes are thereafter punched with the appropriate number of holes and/or apertures. If necessary, the top flap of the envelope is then folded over. Subsequently, and finally, the envelopes are stacked in an orderly manner for further disposition.

Figure 2:
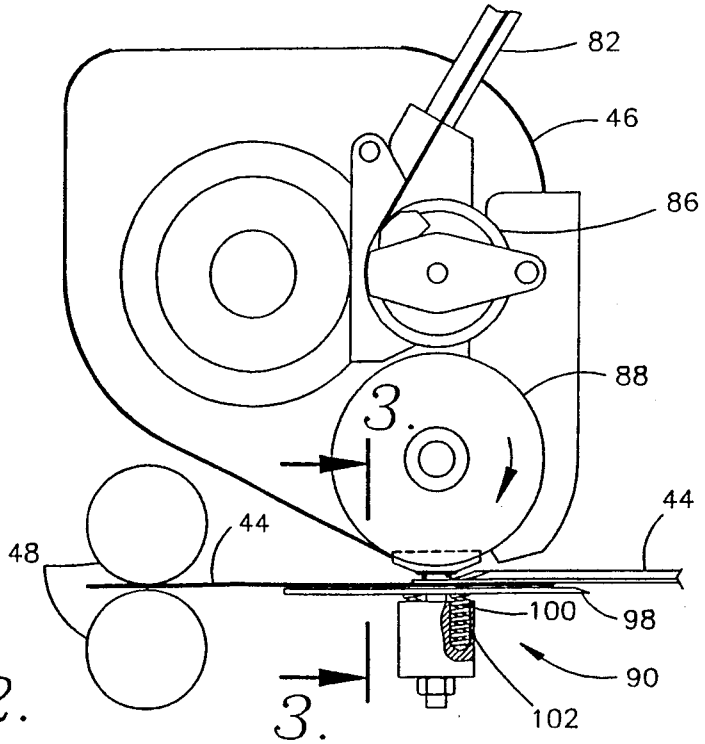
FIG. 2 is a side view of the clasp attaching device and adjustable anvil assembly according to the present invention.
Figure 3:
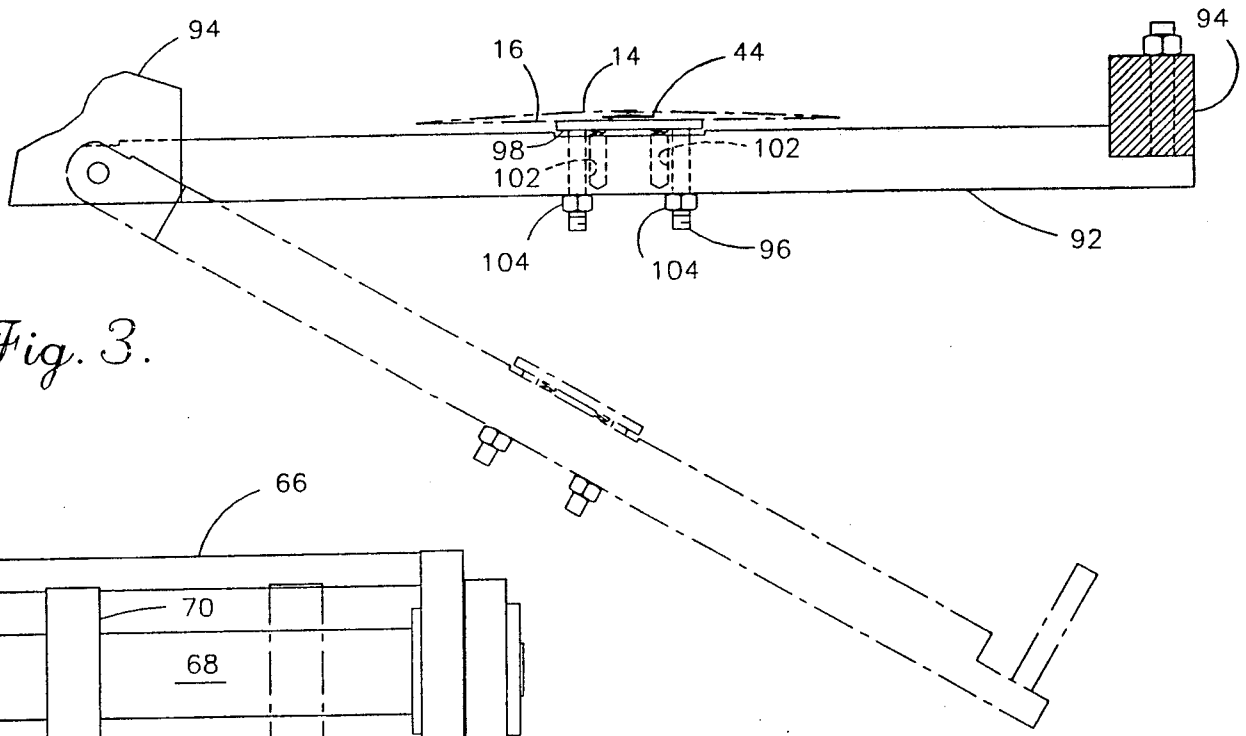
FIG. 3 is a front view of the anvil assembly taken along line 3—3 of FIG. 2.

In addition to the above method and apparatus for forming the envelopes, the present invention is also directed to an improvement in the clasp applicator 46. This is best shown in FIGS. 2 and 3. With reference to these figures, a clasp applicator 46 located vertically above an opposing support plate 44, as in the above-noted U.S. patent, is shown.

The applicator 46 includes an input track 82 to receive a supply of the clasps 26 from a supply, which may include a vibratory bowl feeder 84. The clasps 26 are fed from the track 82 to a transfer wheel 86 which transfers the clasp to an applicator wheel 88. The periphery of the applicator wheel 88 is located at a position sufficiently close to the back panel of the envelope that the prongs of the clasp will be forced through this back panel as the wheel 88 rotates or oscillates.

As may be readily imagined, the pressure applied by the prongs upon the back panel will tend to force the back panel downward. Since this back panel rests only upon the opposing support plate, which is cantilevered by necessity, some mechanism is necessary to provide support to the opposing support plate. In the above-noted patent, this support is provided by a roller fixed slightly below the bottom of the opposing support plate 44 such that the front panel will pass between such roller and the support plate.

In contrast, the present invention employs an adjustable anvil means 90. As is best shown in FIG. 3, the anvil means 90 includes a cross bar 92 which extends laterally across the device 10 and is connected to the frame means 94 of the device. Specifically, one end of the cross bar 92 is pivotally mounted to the frame means and the other end of the cross bar 92 is releasably mounted to the frame means such that the cross bar may pivot between a raised operative position and a lowered inoperative position. The reason for this pivoting will be discussed below.

Extending through the cross bar 92 is at least one locking shaft 96 with the end of the locking shaft adjacent to the support plate 44 being connected to a pressure plate 98. As is best shown in FIG. 2, the front panel 16 of the envelope will pass between the support plate 44 and pressure plate 98. To allow proper travel of the front panel 16 to this intermediate position, the upstream edge of the pressure plate 98 may include an appropriate taper to guide the front panel properly. The anvil means 90 also includes at least one spring 100 mounted in a biased position between the cross bar 92 and pressure plate 98 such that the spring 100 biases the pressure plate upwardly. This may advantageously be provided by plurality of compression springs mounted within appropriate cavities 102 in the cross bar 92. The spring 100 resists the downward movement of the pressure plate 98 in a yielding manner. As such, the pressure exerted by the prongs on the back panel of the envelope may be resisted by the pressure of the spring 100.

This arrangement also allows easy adjustment of the operating conditions of the pressure plate. This is effected by providing an adjustable stop on the locking shaft 96 to prevent its upward movement, and thus upward movement of the pressure plate 98, beyond a specific point. This may be advantageously effected by forming the locking shaft 96 with exterior threads and forming the stop as an appropriate nut 104. In this manner, the vertical placement of the pressure plate may be adjusted by adjusting the placement of the nuts 104 along the length of the locking shaft 96.

Additionally, the use of the nut 104 allows the spring 100 to be pre-compressed to provide a desired amount of resistance against downward pressure. As such, it may be readily envisioned that the spring 100 may be replaced with a spring of a different length or force coefficient to widely vary the opposing force provided by the anvil means 90.

The pivotal mounting of the cross bar 92 allows the anvil means to be moved downward to an inoperative position. This will allow the device 10 to be operated to test the clasp applicator 46 and vibratory bowl 84 without wasting stock paper material.

It should be noted that the anvil means described above could be employed with applicators of a type different than that shown, and that the cross bar could be rigidly mounted rather than pivotable.

While the present invention has been described with reference to a center seam envelope (i.e., side flaps of equal length) it should be clear to those skilled in the art that the present invention is equally applicable to side and bottom seam envelopes.

From the foregoing it will be seen that this invention is one well adapted to attain all ends and objects herein above set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. In an apparatus for attaching clasps, having deformable prongs, to envelopes having first and second panels, the apparatus including frame means, means mounted on said frame means for pressing the clasp against the first panel of the envelope and a support plate positioned in opposed spaced relation to said pressing means and between the panels of the envelope, said support plate being mounted to said frame means, an anvil comprising:

anvil mounting means mounted to said frame means;

a pressure plate mounted on said mounting means for movement in a direction substantially parallel to the pressure applied by the pressing means toward and away from said pressing means, said pressure plate being in opposed spaced relation to said pressing means; and spring means for biasing said pressure plate toward the pressing means, whereby said pressure plate is adapted to resist, via the second panel, support plate and first panel, the pressure applied by the pressing means and thereby limit deflection of the support plate such that the prongs of the clasp may be deformed against the support plate.

2. An anvil as in claim 1, wherein said spring means comprises at least one spring having a first end received in a cavity of said anvil mounting means and a second end abutting against said pressure plate.

3. An anvil as in claim 1, further comprising means for limiting movement of said pressure plate towards said pressing means.

4. An anvil as in claim 3, wherein said pressure plate includes at least one locking shaft extending outwardly therefrom, said mounting means includes at least one through hole extending substantially parallel to the direction of movement of said pressure plate, and said locking shaft is slidably received within said through hole, and wherein said means for limiting movement includes a stop mounted on said locking shaft with said mounting means interposed between said stop and said pressure plate.

5. An anvil as in claim 4, wherein said stop is adjustably mounted on said locking shaft, whereby the spacing between said pressure plate and said pressure means is adjustable.

6. An anvil as in claim 5, wherein said locking shaft is threaded and said stop includes a nut engaged thereon.

7. An anvil as in claim 1, wherein said mounting means includes a first end pivotally mounted to said frame means, and a second end releasably mounted to said frame means, whereby said anvil may be pivoted between an operative position, with the pressure plate in opposed spaced relation to the pressing means, when said second end is connected to the frame means, and an inoperative position when said second end is disconnected from said frame means.

* * * * *